US011208781B2

(12) United States Patent
McCartney

(10) Patent No.: US 11,208,781 B2
(45) Date of Patent: Dec. 28, 2021

(54) COMPACTOR TOOTH BASE HAVING A TRENCH EXTENDING AROUND A CORE

(71) Applicant: Bernard McCartney Limited, Stockport (GB)

(72) Inventor: Neil McCartney, Stockport (GB)

(73) Assignee: Bernard McCartney Limited, Hazel Grove (GB)

( * ) Notice: Subject to any disclaimer, the term of this patent is extended or adjusted under 35 U.S.C. 154(b) by 0 days.

(21) Appl. No.: 16/948,151

(22) Filed: Sep. 4, 2020

(65) Prior Publication Data

US 2020/0399850 A1 Dec. 24, 2020

Related U.S. Application Data

(63) Continuation of application No. 16/049,937, filed on Jul. 31, 2018, now Pat. No. 10,787,785.

(30) Foreign Application Priority Data

Jul. 31, 2017 (GB) ..... 1712276

(51) Int. Cl.
*E02F 9/28* (2006.01)
*E02D 3/026* (2006.01)
*B22D 19/00* (2006.01)

(52) U.S. Cl.
CPC ..... *E02D 3/0265* (2013.01); *B22D 19/00* (2013.01); *E02F 9/2816* (2013.01)

(58) Field of Classification Search
CPC ..... E02F 3/0265; E02F 9/2816; E02F 9/2858; E02D 3/0265

(Continued)

(56) References Cited

U.S. PATENT DOCUMENTS 3,922,106 A 11/1975 Caron et al.
4,668,122 A * 5/1987 Riddle ..... E02D 3/026 404/121

(Continued)

FOREIGN PATENT DOCUMENTS

GB 2 418 181 A 3/2006
WO WO 2009/025776 A1 2/2009
WO WO 2012/116035 A1 8/2012

OTHER PUBLICATIONS

United Kingdom Examination Report issued in Application No. GB1712276.3, dated Jan. 19, 2018, 4 pgs.

(Continued)

*Primary Examiner* — Gary S Hartmann
(74) *Attorney, Agent, or Firm* — Woodard, Emhardt, Henry, Reeves & Wagner, LLP

(57) ABSTRACT

A base for forming a tooth for a wheel of a landfill compactor vehicle. The tooth comprises said base and a cap of a cast metal material formed on said base. The base comprises a block, a core and a lip. The block is adapted to be mounted on said landfill compactor vehicle wheel. The core, which is disposed on a cap-facing side of the base, is for receiving molten metal material during a casting operation and remains embedded in the cap. The lip is disposed around a periphery of the base and is also for receiving said molten metal material, in cooperation with the core. The lip at least partially surrounds the cap-facing side and the core and helps in reducing or preventing imperfections, such as cracks, which could otherwise form at the interface between the base and the cap following the casting operation.

1 Claim, 4 Drawing Sheets

(58) Field of Classification Search
USPC ..... 404/121
See application file for complete search history.

(56) References Cited

U.S. PATENT DOCUMENTS

| | | | | |
|---|---|---|---|---|
| 4,919,266 | A * | 4/1990 | McIntosh, Jr. | B65D 71/14 206/427 |
| 6,632,045 | B1 | 10/2003 | McCartney | |
| 6,991,401 | B1 * | 1/2006 | Caron | E02D 3/026 404/121 |
| 7,112,006 | B2 * | 9/2006 | Moyna | E02D 3/026 404/121 |
| 7,959,375 | B2 | 6/2011 | Brockway | |
| 8,197,157 | B2 | 6/2012 | Brockway | |
| 8,333,439 | B2 * | 12/2012 | Gibbins | E02F 9/2841 301/44.1 |
| 8,449,218 | B2 * | 5/2013 | McPhail | E02D 3/026 404/124 |
| 8,678,517 | B2 * | 3/2014 | Monyak | E21C 35/183 299/113 |
| D718,344 | S | 11/2014 | Brockway | |
| D721,741 | S | 1/2015 | McCartney | |
| 9,192,987 | B2 | 11/2015 | YUaniak et al. | |
| 9,206,576 | B2 * | 12/2015 | Meier | E02D 3/0265 |
| 9,522,425 | B2 | 12/2016 | Yaniak et al. | |
| 10,731,310 | B2 * | 8/2020 | McCartney | B22D 19/00 |
| 10,787,785 | B2 * | 9/2020 | McCartney | B22D 19/00 |
| 2009/0045669 | A1 | 2/2009 | McPhail et al. | |
| 2009/0313805 | A1 | 12/2009 | McPhail et al. | |
| 2012/0055052 | A1 | 3/2012 | Campomanes et al. | |
| 2012/0213586 | A1 | 8/2012 | Ugru | |
| 2014/0299287 | A1 | 10/2014 | Yaniak et al. | |

OTHER PUBLICATIONS

United Kingdom Examination Report issued in Application No. GB1712276.3, dated Mar. 14, 2018, 2 pgs.

* cited by examiner

COMPACTOR TOOTH BASE HAVING A TRENCH EXTENDING AROUND A CORE

CROSS-REFERENCE TO RELATED APPLICATIONS

The present application is a continuation of U.S. patent application Ser. No. 16/049,937 filed Jul. 31, 2018, which claims priority to United Kingdom Patent Application No. 1712276.3, filed Jul. 31, 2017, all of which are incorporated herein by reference.

FIELD OF THE DISCLOSURE

The present invention relates to a base for a tooth for a wheel, such as a steel-drum wheel, of a landfill compactor vehicle; to a tooth for such a wheel; and, to an associated method of manufacturing such tooth. In particular, the present invention relates to a cast metal tooth, a base therefor and an associated method of manufacture by way of casting molten metal on such base.

BACKGROUND

Landfill sites are sites where waste material is disposed of by burying the material beneath the ground surface or by simply letting the waste material accumulate over such surface.

Despite recent efforts to recycle more waste material in order to reduce the amount of waste material arriving at landfill sites, a significant proportion of waste material is still disposed of in this way. Whether waste material is not recyclable or if recycling is not available in that locality, landfill is, in some instances, the only option for disposing of waste material.

SUMMARY

In order to reduce the cost of operating such landfill sites, it is necessary to compact the waste material. Compacting the waste material reduces the volume of waste material, thereby allowing more waste material to be disposed of in any given volume of space.

Compaction of waste material can occur in a number of different ways. However, the most common way of compacting waste material is to use heavy machinery. Large steel-wheeled vehicles, often referred to as landfill compactor vehicles, traverse landfill sites in order to compact and/or break apart waste material.

Landfill compactor vehicles thus have large steel-drum wheels with teeth on their outer surface. These toothed wheels also provide traction for the compactor vehicles. Landfill compactor vehicles are large vehicles with a considerable mass. The teeth of the wheels are therefore placed under considerable stress due to the weight of the vehicle being supported by the teeth as well as the requirement to compact the landfill waste.

It is therefore desirable that the teeth have a high structural strength and that the teeth be also strongly connected to the steel wheels so as to allow the teeth to withstand the high loading forces experienced during operation.

Furthermore, because landfill compactor vehicles spend their operational lives compacting waste material, their teeth are liable to wear down and inevitably require replacing.

It is also therefore desirable that these teeth are also hard wearing such that they do not wear down too quickly in use.

U.S. Pat. No. 6,632,045 B1 discloses a design and method of manufacture of teeth for use in landfill compactor vehicles. U.S. Pat. No. 6,632,045 B1 discloses a two-step casting process whereby a base portion is first cast and a second cap portion is then cast onto the base portion. The base portion is then welded to the steel rim of a wheel of a landfill compactor vehicle whilst the cap provides a hard wearing exterior.

It is therefore also desirable to provide an improved design and/or method of manufacture of a tooth for a wheel of a landfill compactor vehicle, and/or an improved design of a base for such tooth.

According to an aspect of the present disclosure, there is provided a base for forming a tooth for a wheel of a landfill compactor vehicle, the tooth comprising said base and a cap of cast metal material formed on said base, the base comprising:

a block adapted to be mounted on said landfill compactor vehicle wheel;

a core for receiving a molten metal material, said core being disposed on a cap-facing side of said base; and, a lip for receiving said molten metal material in cooperation with the core, the lip being disposed around the base, at least partially surrounding the cap-facing side and the core.

The lip may be disposed around a periphery of the base. The periphery may be defined as a region of the base between the core and an outer edge of the base and/or the block.

The cap and the base may define one or more outer joint lines on an outer surface of the tooth. The lip may be arranged such that one or more of said outer joint lines are defined between the lip and the cap. One or more of said outer joint lines may be defined between an upper side and/or edge of said lip and the cap.

The block may be adapted to be mounted on the wheel of the landfill compactor vehicle in a number of ways. For example, the block may include an arcuate section to allow an underside of the block to fit the wheel.

The block may be made of a material suitable for welding to facilitate attachment of the block to the wheel, an example of such a material being steel.

The core provides a way of securing the cap to the base. When the molten metal material is cast over the base, the lip increases in temperature more quickly than the rest of the base. The increase in temperature of the lip reduces the likelihood of 'chill back' occurring. Chill back refers to the contraction of cooling molten metal material when comparatively high temperature molten metal material is placed in contact with a comparatively low temperature material, such as that of the base and the core in a metal casting process. Chill back can generally result in undesired stress concentrations and, in particular, can result in unsightly and/or structurally weakening cracks at the outer joint lines between the base and the cap. Incorporating the lip as required by the present aspect of the disclosure thus reduces the effects of chill back by providing a thermal mass (of the lip) which is locally lower than the thermal mass of the block without that lip.

In preferred compaction tip bases, the lip completely surrounds the core or at least surrounds the core, continuously or intermittently, i.e. by leaving one or more gaps around the core, for the greatest part of a 360 degrees angle, and preferably for more than 180 degrees or more than 20 degrees. The lip may be disposed on an outer edge of the base.

In other preferred compaction tip bases, when the base is viewed from the cap-facing side, the core is centrally located on the block and the lip is formed on an outer edge of the base.

The lip may be integrally formed with the block. For example, the lip can be made of the same material as the block and the lip and the block may present no interface or other type of discontinuity between them.

Integrally forming the lip with the block may comprise casting the lip and the block as part of the same mould. Being able to form the lip and the block simultaneously reduces the number of manufacturing processes required. Reducing the number of manufacturing processes reduces the cost and complexity of production. Alternatively, the lip may be machined or otherwise realised after the block and/or the base has been cast.

It will be understood that the lip described herein can advantageously be realised as a strip or other distinguishable portion or projection of material having cross-sectional height and/or width substantially smaller, eg a factor 10 or more, than a length along which the lip develops/extends around the base or periphery thereof.

At least part of the core may raise above an upper surface of the lip.

The core may therefore provide a greater mass than the lip with which to anchor the cap to the base. The configuration with the core above the upper surface of the lip may therefore increase the ability of the cap to be retained on the tooth under significant loads.

A recess may generally be defined between the lip and the core. The presence of a recess between the lip and the core may be advantageous because the recess may facilitate more homogenous cooling of the base and the cap.

The lip may have a cross-sectional area of between 25 $mm^2$ and 2500 $mm^2$.

The lip may have a generally constant cross-sectional area along its length or at least along a portion thereof.

Casting a lip having a generally constant, uniform cross-sectional area may be advantageous from a manufacturing point of view. Furthermore, keeping the cross-sectional area of the lip generally constant may be advantageous because it allows the thermal mass of the lip to be uniform around the base.

The lip may have a cross-sectional profile of one of a square, rectangle, triangle or semi-circle. However, other geometries are also possible. For example, the lip may comprise a curved side and said curve may define a saddle comprising opposite concavities. The curve and/or either of the concavities may be generally facing the core.

According to a further aspect of the present disclosure, there is also provided a tooth for a wheel of a landfill compactor vehicle, the tooth comprising a base as described above, having any optional feature thereof, and a cap of cast metal material formed on said base.

According to a further aspect of the present disclosure, there is provided a method of forming a tooth for a wheel of a landfill compactor vehicle, the tooth comprising a base and a cast metal material cap formed on said base, the method comprising:

providing a base comprising a block adapted to be mounted on said landfill compactor vehicle wheel, a core for receiving a molten metal material disposed on a cap-facing side of said base, and a lip for receiving the molten metal material in cooperation with the core, the lip being disposed around said base at least partially surrounding the cap-facing side and the core; and casting the molten metal material on said base to form the cast metal material cap and thus the tooth.

According to a further aspect of the present disclosure, there is provided a tooth for a wheel of a landfill compactor vehicle, the tooth comprising:

a base comprising a block adapted to be mounted on said landfill compactor vehicle wheel and a core for receiving molten metal material disposed on a cap-facing side of the base, the base having one or more outer base sides surrounding said cap-facing side and defining one or more upper side ends disposed towards the cap-facing side and the core; and, a cap made of a cast metal material formed on said base and at least partially embedding said core, the cap having one or more outer cap sides having one or more lower side ends disposed towards the cap-facing side of the base and meeting said upper side ends of the base at one or more outer joint lines defined between the base and the cap;

wherein said lower side ends of the cap are shaped and/or dimensioned so as to define a region of increased thickness of cast metal material located directly above and in proximity of said one or more outer joint lines.

The base may have a cylindrical or generally cylindrical outer surface. In this case, said increased thickness of cast metal material may define a corresponding outer surface on the cap extending generally in the same direction of said cylindrical surface of the base.

The increased thickness of cast metal material present between the upper and lower side ends of respectively the base and the cap is beneficial because the cooling of the base and the cap is more homogenous. The effects of chill back can thus be beneficially reduced as a result thereof.

The increased thickness of said cast metal material may define one or more outer cap sides coplanar or substantially coplanar with the one or more outer sides of the base.

The one or more outer sides of the base may define one or more upper edges.

The one or more outer cap sides may define one or more lower edges.

The one or more upper edges may adjoin the one or more lower edges.

The increased thickness of the cast metal material may be located directly above the one or more upper edges.

The increased thickness of cast metal material present above the upper side end or ends of the base may be between 5 mm and 15 mm.

In preferred compaction teeth, the increased thickness of cast metal material present above the upper side end or ends of the base may be around 10 mm.

The one or more outer cap sides may preferably be sloping towards the core, thereby defining one or more outer cap side taper angles. Said taper angles may generally be greater than 10 degrees.

Preferably, the one or more outer cap sides generally surround the core. The core may thus be fully embedded by the cap.

According to a further aspect of the present disclosure, there is provided a method of forming a tooth for a wheel of a landfill compactor vehicle, the tooth comprising a base and a cast metal material cap formed on said base, the method comprising:

providing a base comprising a block adapted to be mounted on said landfill compactor vehicle wheel, a core for receiving a molten metal material disposed on a cap-facing side of said base, the base having one or more outer sides disposed at least partially around said cap-facing side and defining one or more upper side ends towards said cap-facing side and the core;

casting a molten metal material on said base to form a cast metal cap and thus the tooth, wherein the cast metal material cap at least partially embeds said core and has one or more outer cap sides defining lower side ends disposed towards the cap-facing side of the base and meeting said upper side ends of the base at one or more outer joint lines defined between the base and the cap, wherein said lower side ends of the cap are shaped and/or dimensioned so as to define a region of increased thickness of cast metal material located directly above and in proximity of said one or more outer joint lines.

Unless otherwise stated, features described above in connection with any one of the aspects of the present disclosure are also intended to be applicable to any other one of those aspects.

BRIEF DESCRIPTION OF THE DRAWINGS

Specific bases, teeth and/or related methods will now be described, by way of example only, with reference to the accompanying drawings in which.

DESCRIPTION OF EMBODIMENTS

Figure 1:
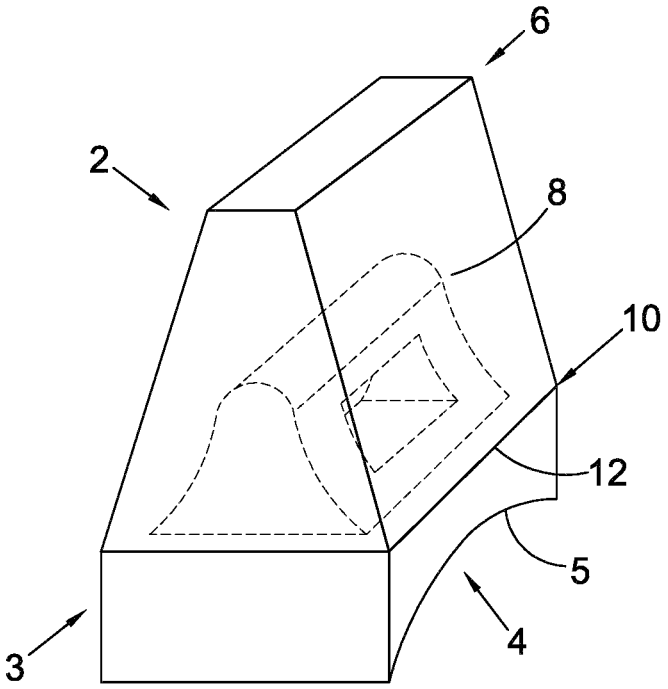
Figure 1 Prior Art
FIG. 1 is a perspective view of a prior art tooth.

Referring to FIG. 1, a perspective view of a tooth 2 for a wheel of a landfill compactor vehicle is depicted according to the prior art. The tooth 2 comprises a base 4 and a cap 6.

The tooth 2 may be around 160 mm wide by around 225 mm deep and be around 190 mm in height. Alternatively, the tooth 2 may be around 185 mm wide by around 195 mm deep and be around 200 mm in height. These dimensions are provided as examples and are not limiting. Alternatively, the tooth may be 200 mm wide by 200 mm deep and be 250 mm high. Both the base 4 and cap 6 are cast using a metal material. Non-limiting examples of metal materials include pure metals and alloys.

The base 4 comprises a block 3 and a core 8.

In use, an arcuate section 5 of the block 3 is welded to a steel drum of a wheel of a landfill compactor vehicle (not shown). The arcuate section 5 is one way in which the base 4, and so the tooth 2, is adapted to be secured to be mounted on a wheel of a landfill compactor vehicle. Each wheel may have a plurality of teeth attached to it such as, for example, 40 teeth. As the landfill compactor vehicle traverses landfill sites, the teeth on the wheels compact the waste under the weight of the vehicle. Waste is compacted primarily by the cap 6 of the tooth 2. The tooth 2 is therefore liable to wear after prolonged use.

The tooth is manufactured in a two-part casting process. In the process, the base 4 is initially cast and allowed to cool. With the base 4 set, the base 4 then forms part of a mould into which a molten metal material which forms the cap 6 is poured and allowed to set. The tooth 2 can therefore be manufactured to have a weldable base 4 and a hard-wearing cap 6 in a single body (with the two parts secured together). This is achieved by manufacturing the base 4 and the cap 6 from two different materials.

The core 8 incorporates a retention feature. The retention feature secures the cap 6 to the base 4, improving the strength of the tooth 2. In FIG. 1 the core 8 is illustrated with a dashed line to indicate that the core 8 is not visible once the cap 6 is cast onto the base 4. During manufacture, the cast metal material cap 6 at least partially embeds the core 8. That is to say, the cap 6 is fixed and forms a surrounding structure for the core 8 and thus the base 4.

A problem associated with certain designs of landfill compactor teeth according to the prior art is 'chill back'. Chill back refers to the contraction of molten metal material due to a reduction in temperature as the metal cools. Chill back occurs because as metal decreases in temperature, it also reduces in volume. The contraction of the metal is related to the change in temperature of the body.

Chill back may be a problem because the (hot) molten metal material of the cap 6 is received by, and therefore comes into contact with, the (cold) base 4. In the regions near the upper edges 10 of the base 4, the thermal mass of the base 4 is locally higher than that of molten metal material which will form the cap 6. When the molten metal material of the cap 6 comes into contact with the base 4 in the regions near the upper edges 10, the temperature of the molten metal material of the cap 6 reduces in these regions more quickly than in the rest of the cap 6. The more rapid decrease in temperature of the molten metal material forming the cap 6 in these regions, compared to the rest of the cap, can lead to unwanted stress concentrations in the finished products or, in extreme cases, to cracks or other material discontinuities which may even be visible from outside.

The thermal mass of a body $m_{th}$ is the product of the mass of the body m and the specific heat capacity of that body $c_p$:

$$m_{th}=mc_p$$

The mass of the body, m, is the product of the density of the body, ρ, and the volume of the body, V:

$$m=\rho V$$

When considering a basic three dimensional body, such as a block or a prism, the thermal mass of the body is proportional to the cross-sectional area of the body. This is because the volume of the body is equal to the cross-sectional area of the body multiplied by the depth of the body.

For a given quantity of thermal energy, Q, transferred to a body, the resulting temperature change of the body, ΔT, can be calculated using the following equation:

$$Q = m_{th}\Delta T = mc_p\Delta T = \rho V c_p \Delta T \rightarrow \Delta T = \frac{Q}{m_{th}}$$

$$\Delta T \propto \frac{1}{m_{th}}$$

The above equations explain why the comparatively higher thermal mass of the base 4 relative to the cap 6 in the regions near the upper edges 10 may be a cause for concern. As mentioned above, heat will transfer from a higher temperature body to a lower temperature body. Also, the increase in the temperature of a body for a given quantity of heat energy transferred to it is inversely related to the thermal mass of the body. That is to say, for a given amount of heat energy transferred to a body, the temperature of a body with a lower thermal mass will increase more than the temperature of a body with a higher thermal mass. Thermal mass can be considered to be the resistance of a body to changes in temperature. A body having a high thermal mass will require more energy to increase its temperature by a given quantity. Correspondingly, a body having a low thermal mass will require less energy to increase its temperature by a given quantity.

The higher thermal mass of the base 4 relative to the cap 6 means that the base 4 acts, at least in certain regions of the tooth, as a thermal sink. That is to say, the base 4 in those regions absorbs the heat energy from the cap 6 more rapidly than in other regions. The comparatively more rapid reduction of the temperature of the cap 6 in those regions may result in a locally more marked reduction in the volume of the cap 6. This may give rise to unwanted internal stresses in the tooth, or even material discontinuities such as cracking.

Unsightly and structurally weakening cracks may show particularly at external joint lines 12 between the base 4 and the cap 6, particularly in the regions near the upper edges 10. The cracks may give the false impression that the cap 6 is not properly secured to the base 4. This may, in turn, be a cause of concern for landfill operators. Further, these cracks may also provide regions for waste material to deposit and snag, which is also undesirable. In colder climates, water may enter the cracks, freeze and expand in volume. Such constrained expansion may have the effect of levering the cap 6 away from the base 4.

A solution to the above problems could be to heat up the base 4 such that the temperature of the base 4 is closer to that of the molten metal material of the cap 6, and let the base and the cap cool more homogeneously. In this instance, there would fewer temperature gradients between the molten metal material of the cap 6 and the base 4, especially in and around the upper edges 10. There would therefore be less contraction of the cap 6 in the upper edges 10 when the molten metal material of the cap 6 comes into contact with the base 4.

However, due to the size and thermal mass of the base 4, heating the base 4 is undesirable for reasons of cost and time required.

Figure 2:
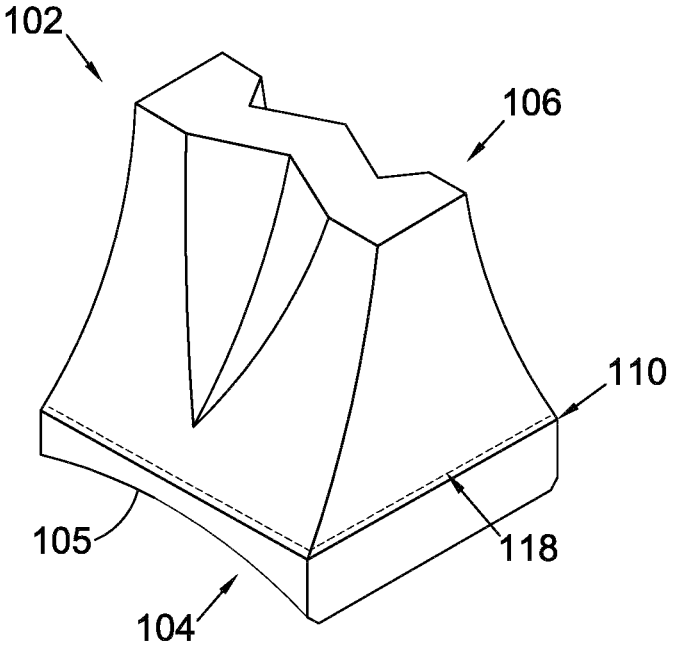
FIG. 2 is a perspective view of a tooth according to a first aspect of the disclosure.

FIG. 2 illustrates a tooth 102 manufactured according to a method according to an aspect of the present disclosure. The base 104 of FIG. 2 is modified compared to the prior art (as illustrated in FIG. 3 in more detail) such that when the cap 106 is cast onto the base 104, there are no cracks (or smaller cracks) in the regions near upper edges 110 of the base 104.

Figure 3:
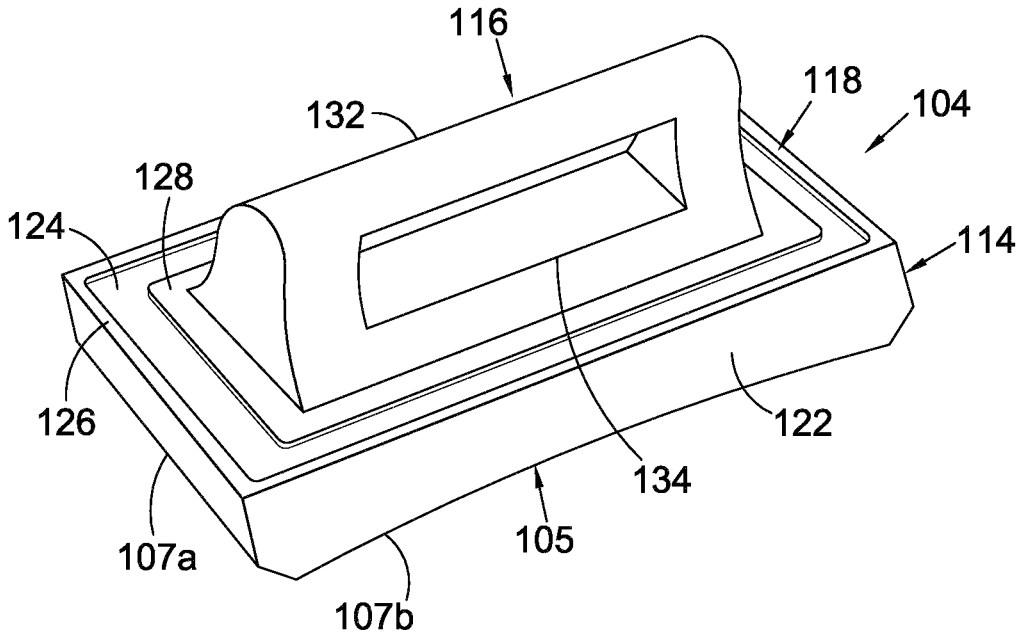
FIG. 3 is a perspective view of a base used for forming the tooth of FIG. 2.

FIG. 3 illustrates the modified base 104. The base 104 comprises a block 114, a core 116 and a lip 118.

The block 114 of the base 104 is in the form of a cuboid when viewed from above. In other words, the block 114 of the base 104 is generally shaped like that of a thickened plate, save for an arcuate section 105 at an underside of the block 104. When viewed from above, a cap-facing side of the base 104 is visible. The arcuate section 105 provides a surface which is contoured to fit to the exterior of a drum of a wheel of a landfill compactor vehicle. This is how the tooth 106 is mounted to the wheel of the landfill compactor vehicle. Typically the tooth 106 is welded to the wheel. Lower edges 107*a-b* of the base 104 may incorporate weld preparation features. Weld preparation features may be incorporated into an assembly which is to be welded together in order to improve the strength of the welded joint(s) and accommodate welding equipment such as a tip of a welding gun. One non-limiting example of a weld preparation feature is an edge which is at least partly chamfered. In FIG. 3, the base 104 is at least partly chamfered along shorter lower edges whereas in FIG. 2 the base 104 is at least partially chamfered along longer lower edges. Either option, or a combination thereof, may be used.

The base 104 comprises a lip 118. The lip 118 is disposed on the cap-facing side of the base 104. The lip 118 surrounds the cap-facing side of the base 104 and the core 116. In this described base, the lip 118 takes the form of a rectangular profile swept about a perimeter of the cap-facing side of the base 104. That is to say, in the described base, the lip 118 has a generally continuous cross-section in a plane normal to the perimeter of the cap-facing side of the base 104.

Although the illustrated lip 118 has a generally continuous cross-sectional profile of a rectangle along its length, other cross-sectional profiles may be used. For instance, the cross-sectional profile may be square, triangular or semi-circular. Alternatively, the cross-sectional profile may not be continuous and may vary, such as it may provide for gaps along the lengthwise extension of the lip 118. For example, the cross-sectional profile of the lip may be larger in some places then others. Alternatively, the lip 118 may be regularly intermittent around the perimeter of the cap-facing side of the base 104. That is to say, there may not be a lip in some sections of the perimeter of the cap-facing side of the base 104, at regular intervals.

The lip 118 is integrally formed with the block 114. When the base 104 is viewed from the side or end i.e. such that an arc of the arcuate section 105 is visible or is not visible respectively, an outer wall 122 of the base 104 spanning both the block 114 and the lip 118 is continuous. That is to say, an outer wall of the block 114 and an outer wall of the lip 118 are flush. The base may be a cast metal material base. When the base 104 is cast, the lip 118 and block 114 may be cast simultaneously. Alternatively, the lip 118 may be added to the block 114 subsequent to the production of the block 114. It will be apparent that such addition may be by way of removing material from the base 104, for example by way of machining. It will be appreciated by the skilled person that there are many more different ways of providing a lip around the cap-facing side of the base 104.

In the described base for a tooth of a compaction vehicle, the lip 118 defines a rectangular inner recess 124 on the cap-facing side of the base 104. The recess 124 is formed adjacent the lip 118 and the core 116 of the base 104. The recess 124 is an area which is recessed relative to an upper surface 126 of the lip 118. That is to say, relative to the lowest point of the arcuate section 105, the height of an uppermost surface of the recess 124 is less than the height of the upper surface 126 of the lip 118. In FIG. 3, the recess 124 takes the form of a trench which surrounds the core 116. In other compaction tooth bases, the recess may not be of the form of a trench. The recess 124 may be, for example, 3 mm deep and 14 mm wide (when viewed in cross-section, as shown in FIG. 5*b*). These dimensions are provided as examples only and are not intended to be limiting.

The core 116 is located on a platform 128 which is raised above the uppermost surface of the recess 124. The platform 128 is an optional feature. In alternative compaction tooth bases, the platform 128 may not be present. Where the platform 128 is not present, the core 116 may be positioned on the uppermost surface of the recess 124. In such bases, the recess 124 may lead into the core 116, such that respective surfaces are continuous. The core 116 and cap-facing side of the base 104 are at least partially surrounded by the lip 118.

The core 116 comprises a retention feature to enable the cap 106 to securely attach to the base 104. The retention feature is that of a bell section 132. The bell section 132 is so named because, viewed from an end of the base 104 i.e. such that the arcs of the arcuate section 105 are not visible, the feature is like that of an extruded bell shape. The bell section 132 has an opening 134 in the form of a through bore. That is to say, the opening 134 passes from one side of the bell section 132 to the other. The opening 134 provides an attachment point through which molten metal material of the cap 106 passes. Thus, when the cap 106 is cast onto the base 104, a securing portion of the cap 106 passes through the opening 134. That is to say, the cap 106 at least partially embeds the core 108. When the cap 106 sets, the cap 106 is securely attached to the base 104 via the opening 134.

Figure 4:
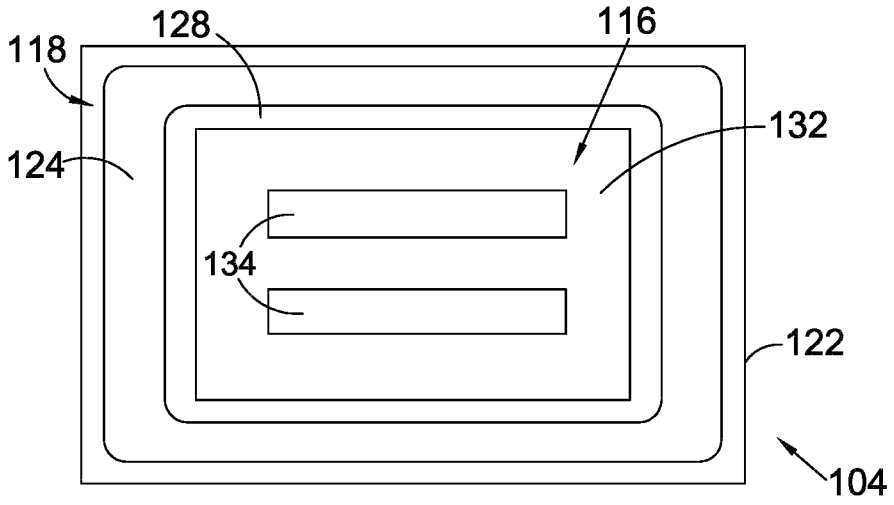
FIG. 4 is a plan view of the base depicted in FIGS. 2 and 3.

FIG. 4 illustrates the base 104 in plan view. That is to say, FIG. 4 shows the base 104 as viewed from the cap-facing side.

Figure 5A:
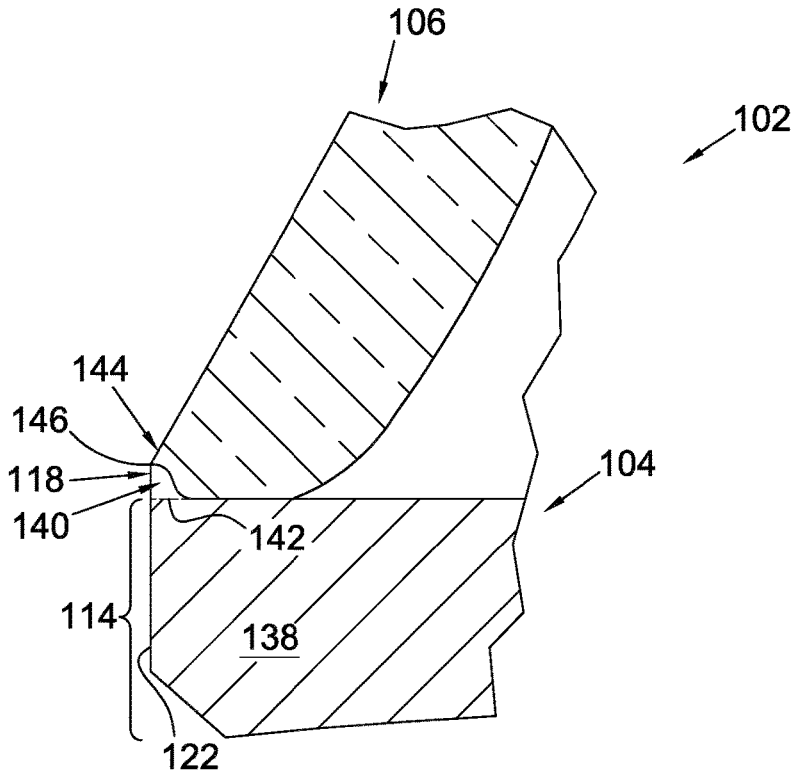
FIG. 5*a* is a cross-section view of part of the tooth of FIG. 2 with an alternative lip.
Figure 5B:
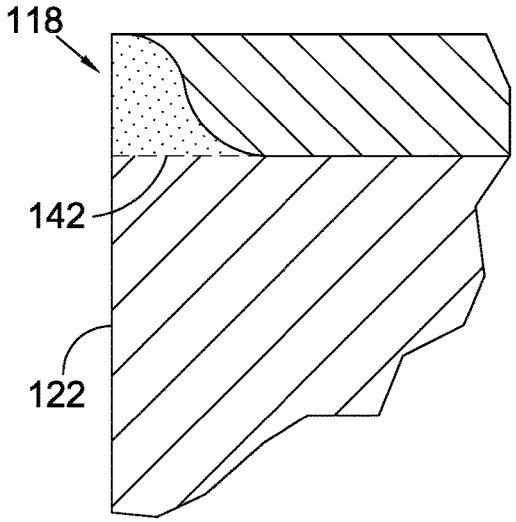
FIG. 5*b* shows an enlarged cross-section of FIG. 5*a;*

FIG. 5*a* illustrates a cross-sectional view of part of the tooth 102. The cross-sectional view is taken perpendicular to the outer wall 122. Only a lower part of the cap 106 is illustrated in FIG. 5*a*, as indicated by a segmented upper line. The upper part of the cap 106 is not of importance for the purposes of the present aspect of the disclosure. Similarly, only an outer part of the base 104 is illustrated, an inner part not being of importance for the purposes of the present aspect of the disclosure. In FIG. 5*a*, there is no platform.

FIG. 5*a* shows part of the block 114, the part having a cross-section 138. FIG. 5*a* also shows the lip 118, the lip having a cross-section 140. The lip 118 of FIG. 5*a* is more curved than the lip 118 shown in previous Figures. This is shown in detail and discussed in connection with FIG. 5*b*. The outer wall 122 is also illustrated. FIG. 5*a* also shows part of the cap 106. Dashed line 142 is also shown in FIG. 5*a* to aid in the explanation of the present aspect of the disclosure. However, line 142 is not a physical line as the lip 118 is integrally formed with the block 114.

It will be recalled that chill back is the contraction of molten metal material on cooling. In particular, as shown in FIG. 5*a*, a region 144 of the cap 106, an outer volume near joint line 146 where the cap 106 meets the lip 118, is liable to suffer from chill back which is reduced or eliminated by the presence of the lip 118. This is because the cross-sectional area of the cap 106 in the region 144 is relatively low and the thermal mass of the cap 106 in the region 144 is therefore also relatively low. The imbalance of the thermal masses in the region 144 can lead to different rates of cooling in the cap 106 and the base 104 and, therefore, chill back. Chill back in this region 144 can also cause cracks which are visible from the exterior of the tooth 102. The presence of the lip 118 thereby inhibits or reduces cracking due to chill back.

By incorporating the lip 118 into the base 104, the lip 118 provides a reduced cross-section 140 in contact with the region 144 of the cap 106. This is in comparison with the cross-section 138 of the block 114 which would otherwise be in contact with the region 144 of the cap 106. As the lip 118 has a smaller cross-section 140 than the block 114, the lip 118 has a smaller thermal mass than the block 114.

The area of the cross-section 140 of the lip 118 may be between 25 $mm^2$ and 2500 $mm^2$.

The inclusion of the lip 118 has a similar effect to heating a localised zone of the base 104, but without the associated financial, energy and time costs of heating the entire base 104. Instead, the lip 118 provides a small volume of the base 104 near the exterior joint line 146 which, when the cap 106 is cast, will heat up more quickly than the rest of the block 114. The effects of chill back in the cap 106 are therefore reduced in the region 144 around the exterior joint line 146 between the base 104 and the tooth 106.

Furthermore, the profile of the lip 118 means that only one face 142 of the lip 118 is connected to the block 114. This means that there is limited surface area available to provide a conduction pathway between the lip 118 and the block 114. The rate of heat conduction from the lip 118 to the block 114 is reduced as a result. Less heat is therefore able to conduct from the lip 118 into the block 114. Subsequently, less heat is transferred from the lip 118 to the block 114. The single connected face 142 therefore assists in maintaining a higher temperature in the lip 118 compared to the block 114 and reduces chill back.

An advantage of the described compaction tooth base as described thus far is that contraction of the cap 106 caused by chill back is locally reduced or eliminated. Furthermore, this is achieved without altering the external dimensions of the tooth 102. It is therefore possible to improve the appearance and strength of the tooth 102 without modifying the external dimensions. This is of use because, for customers who already incorporate the prior art tooth design into their landfill compactor vehicles, no design changes are required for the vehicle itself to be able to incorporate a tooth according to aspects of the present disclosure. The customer can therefore affix the tooth according to these aspects of the disclosure to existing and/or newly produced landfill compactor vehicles without incurring any cost to modify the vehicles.

A further advantage of the lip 118 is that when the cap 106 is cast, molten metal material can flow over the outer wall 122 of the base 104. By being allowed to flow over the outer wall 122 of the base 104, lower portions of the cap 106 may overhang the outer walls 122 of the base 104. If chill back occurs, the most significant effects of chill back will occur in the overhanging regions. Once the cap 106 has set, the overhanging regions can be fettled i.e. filed away or trimmed, thereby leaving a new edge of the cap 106 where chill back is less severe, if present at all. Effectively, the above method provides a sacrificial part of the cap 106 which can be removed to reveal a previously enclosed part of the cap 106 with reduced chill back.

FIG. 5*b* is a close-up of the lip 118 of FIG. 5. FIG. 5*b* illustrates the rounded lip 118. The lip 118 has the profile of a partial "S" shape (inverted in the Figure), a rounded profile. The S shape profile includes two fillets which define the rounded profile. Such a profile is beneficial because casting a lip 118 having the rounded profile is easier from a manufacturing perspective than the rectangular lip as illustrated in FIGS. 3 and 4. The lip 118 as shown in FIG. 5*b* may be 5 mm high and 3 mm wide. Fillet radii of between 0.25 mm and 3.5 mm may be used. These dimensions are provided as examples only and are not limiting.

Figure 5C:
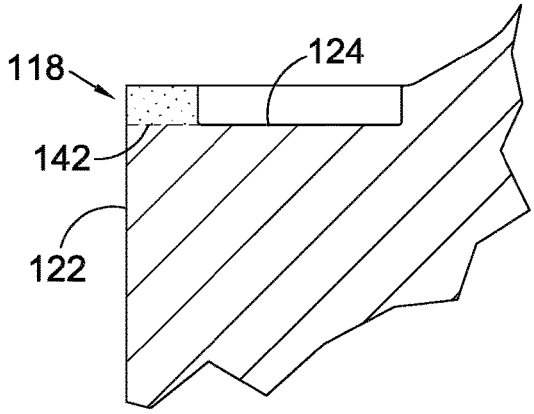
FIG. 5*c* shows an enlarged cross-section of the tooth of FIGS. 2-4.

FIG. 5*c* is a close-up of the lip 118 of FIG. 3. FIG. 5*c* illustrates a rectangular lip 118. The lip may be 3 mm high and 5 mm wide. These dimensions are provided as examples only and are not limiting.

Figure 6:
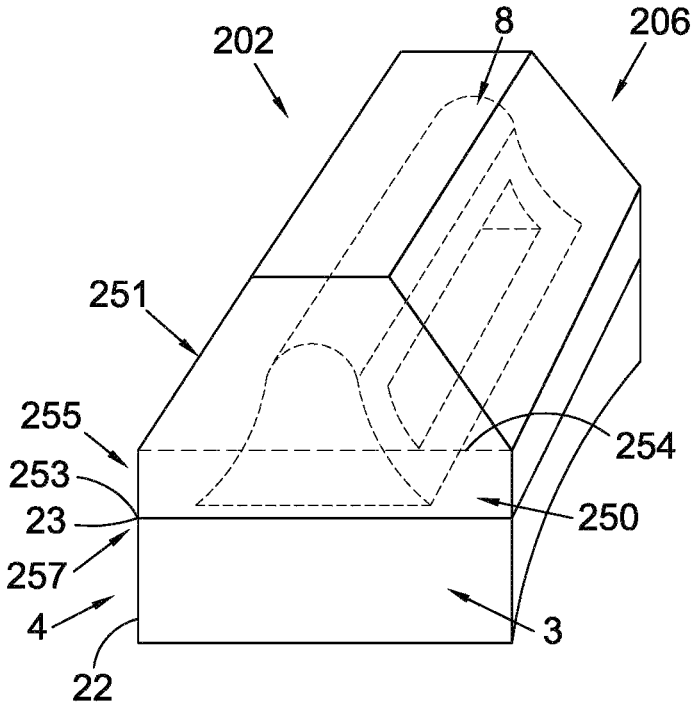
FIG. 6 is a perspective view of a tooth according to a second aspect of the disclosure.

An alternative aspect of the present disclosure is illustrated in FIG. 6. In FIG. 6, a tooth 202 comprises a base 4 according to the prior art. However, the tooth 202 also comprises a cap 206 design which differs from that of the prior art. The cap 206 is also designed to reduce chill back.

The cap 206 is modified to include a rectangular lower portion 250. Rectangular lower portion 250 is the portion of the cap 206 beneath a dashed line 254 in FIG. 6. Dashed line 254 is included in FIG. 6 to aid in the explanation but this is not a physical line and is shown merely to aid understanding.

The cap 206 has outer cap sides 251 which slope towards the core 8. The cap 206 also has outer lower side ends 255 which are disposed towards the cap-facing side of the base 4. Outer cap sides 251 also define lower side edges 253.

The base 4 has outer sides 22. Outer sides 22 define upper edges 23. The base 4 also has outer upper side ends 257 disposed towards the cap-facing side.

Upper edges 23 adjoin lower edges 253. That is to say, respective upper edges 23 and lower edges 253 are joined to one another.

In the illustrated compaction tooth, there is an increased thickness of cast metal material present directly above and in proximity of each of the upper edges 23. The thickness of cast metal material corresponds to the rectangular portion 250. The thickness of cast metal material is located directly above and in proximity of the upper edges 23 of the base 4 and is defined by the shape and/or dimension of the outer sides 251 of the cap, more particularly by the shape and/or dimension of the lower side ends 255 thereof.

When the tooth 202 of FIG. 6 is compared with the tooth 2 of FIG. 1, it is clear that there are differences. When viewed from a short side of the tooth 2, the cap 6 of the tooth of FIG. 1 has a profile of a trapezium. In contrast, when viewed from a short side of the tooth 202, the cap 206 of the tooth 202 of FIG. 6 has a profile of an irregular hexagon. The difference in the geometries of the caps is due to the additional increased thickness of material which is present directly above each of the upper edges 23 in the redesigned tooth 202. Although in the compaction tooth shown in FIG. 6 the additional increased thickness extends above the edges 23 of the base perpendicularly with respect to the plane of the cap-facing side of the base (and in the same direction with respect to the sides 22 of the base), it will be appreciated that alternative compaction teeth may depart from this feature. In particular, it is contemplated that the outer sides of the additional increased thickness of material defined by the shape of the lower ends 255 of the outer sides 251 of the cap 206 may extend at an acute or obtuse angle insofar as they are consistent with the requirement of providing a thickened volume of cap material at its lower end compared to the prior art shown in FIG. 1.

The increased thickness of the cast metal material present between the outer upper and lower side ends may be around 10 mm. Alternatively, the thickness may be between 5 mm and 15 mm.

Figure 7:
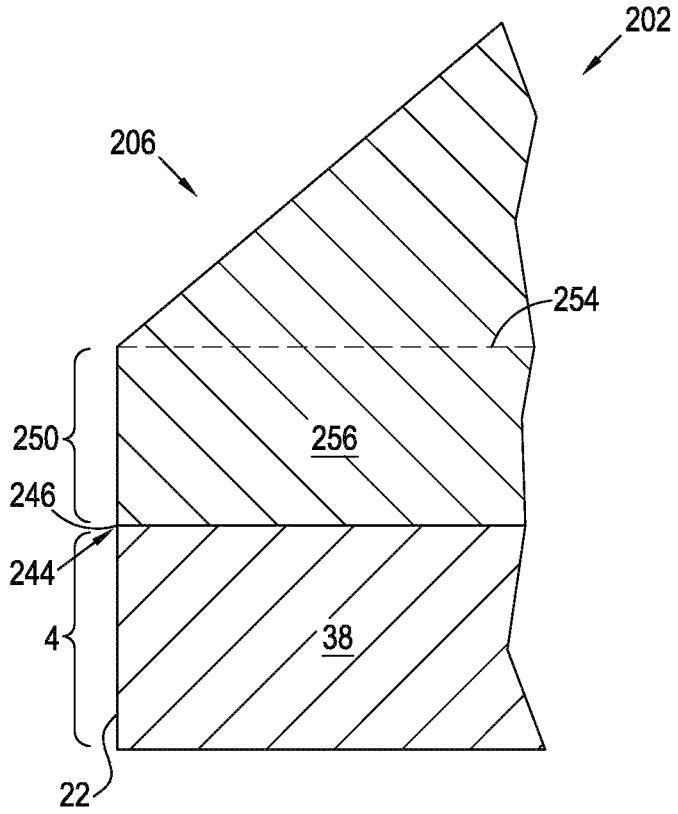
FIG. 7 is a cross-section view of part of the tooth of FIG. 6.

FIG. 7 is a cross-sectional view of part of the tooth 202. The cross-sectional view is taken perpendicular to one of the outer block sides 22. Only an outer part of the tooth 202 is shown.

The base 4 has a cross-section 38. The cap 206 has a cross-section 256. A region 244 exists where the cap 206 meets the base 4 near a joint line 246.

By incorporating the rectangular portion 250 into the cap 206 (beneath dashed line 254), the cross-sectional area 256 of the cap 206 is increased in the region 244 near the joint line 246. The thermal mass of the cap 206 is therefore increased in and around the region 244. The increased thermal mass of the cap 206 at the region 244 means the thermal mass of the base 4 is more closely matched to that of the cap 206. The cooling of the cap 206 and the base 4 is therefore more homogenous during manufacture, thereby reducing or avoiding the risk of unwanted internal stresses in the tooth, or cracking.

Although the illustrated base is generally rectangular when viewed from above, this is just one non-limiting example. Alternatively, the base may be generally square or circular. The same applies for the tooth.

Corners which are illustrated as sharp corners may be filleted. For example, fillets of a radius of between 2 mm and 10 mm may be implemented.

Walls and other features which are illustrated as being vertical and/or perpendicular may be tapered. For example, walls may have a taper of between 0.5° and 3°. The taper may be to allow the cast part to be removed from a mould more easily. This is distinct with respect to the tapering of the caps shown in the Figures, which instead may encompass angles of more than 20, or more than 30 or more than 40 degrees.

The described and illustrated compaction tooth bases, compaction teeth and related methods are to be considered as illustrative and not restrictive in character, it being understood that only preferred compaction tooth bases, compaction teeth and related methods have been shown and described and that all changes and modifications that come within the scope of the inventions as defined in the appended claims are desired to be protected.

In relation to the claims, it is intended that when words such as "a," "an," "at least one," or "at least one portion" are used to preface a feature there is no intention to limit the claim to only one such feature unless specifically stated to the contrary in the claim.

When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. The optional and/or preferred features for each aspect of the disclosure set out herein are also applicable to any other aspects of the disclosure, where appropriate.

The invention claimed is:

1. A method of forming a tooth for a landfill compactor vehicle wheel, the tooth comprising a base and a cast metal material cap cast onto said base, the method comprising:

first, providing a base comprising:

a block adapted to be mounted on said landfill compactor vehicle wheel;

a core disposed on a first side of said base, the core comprising a retention feature; and a trench disposed on the first side of the base and extending around the core; and secondly, casting a molten metal material onto at least the core and the trench of said base to form the cast metal material cap and thus the tooth, such that the cap interlocks with the retention feature to secure the cap to the base.

* * * * *